United States Patent [19]

Pobuda et al.

[11] 3,948,164

[45] *Apr. 6, 1976

[54] CAN FLATTENING APPARATUS

[76] Inventors: Eckhard T. Pobuda, 1325 Lafayette St., Denver, Colo. 80218; Robert E. Krebs, 2000 Crystal Springs Road, San Bruno, Calif. 94066

[ * ] Notice: The portion of the term of this patent subsequent to Apr. 16, 1991, has been disclaimed.

[22] Filed: Feb. 19, 1974

[21] Appl. No.: 443,850

[52] U.S. Cl. ..... 100/98 R; 100/DIG. 2; 100/233; 100/293

[51] Int. Cl.[2] ..... B30B 1/04

[58] Field of Search ..... 100/DIG. 2, 98 R, 233, 100/293

[56] References Cited

UNITED STATES PATENTS

| | | | |
|---|---|---|---|
| 2,234,098 | 3/1941 | Wells | 100/DIG. 2 |
| 3,804,004 | 4/1974 | Krebs et al. | 100/DIG. 2 |

*Primary Examiner*—Billy J. Wilhite

[57] ABSTRACT

Apparatus includes a base having an elongated concave depression formed therein into which a cylindrical can may be laid upon its side. An arm on the base pivots down towards the base and carries an arcuate, convex die member for flattening the can body and cutting members to pierce the can body in advance of the die member.

4 Claims, 2 Drawing Figures

CAN FLATTENING APPARATUS

STATE OF THE ART

Litter of the environment is an exceptionally important problem. A significant amount of the litter is comprised of aluminun cans which, unfortunately, are very slowly degradable by natural corrosion. In fact, the depth of attack of corrosion on exposed aluminum due to the elements is usually only one or two mils (thousandths of an inch) during the first and second years of exposure: thereafter, the rate of depth penetration decreases rapidly. In mild climates, the rate of depth attack may fall to 0.03 mil per year after the second year. Since the wall thickness of a typical aluminum can of the type used for beers or soft drinks is approximately 5 mils, with the tops and bottoms considerably thicker, the time for an aluminum can to be eliminated by corrosion may be several hundred years. When the can has a painted or otherwise protected surface, the can life may go well beyond 200 years. Aluminum cans which are carelessly tossed away today may continue to litter the land for scores of generations.

Aluminum cans are becoming exceedingly plentiful today. Industry has estimated that nearly five billion alluminum cans were produced in 1970. In other words, about 2,000 tons of aluminum were used in 1970 for aluminum cans. If only a minute percentage of these cans are carelessly tossed away along highways and in parks each year, the amount of litter which will accumulate over a few years is tremendous.

On the other hand, aluminum is a relatively expensive metal. Currently, aluminum sells at about 27 cents per pound and scrap dealers are willing to pay about ten cents per pound. Since about 25 cans weigh about a pound, each can has a value of about one-quarter cent if sold to a scrap dealer. Seemingly, householders should be encouraged to save and redeem aluminum cans. To some extent this has been done; for example, about one hundred million aluminum cans were collected in eleven Western states and sold back to a brewery for nearly 500,000 dollars in 1970. However, the typical householder finds it extremely inconvenient to save large numbers of aluminum cans because of the relatively light weight cans each occupy a large amount of storage space. Furthermore, because of the manner in which aluminum cans are formed and because of the softness of the metal, the usual can opener will not operate upon an aluminum can to cut out the top and bottom so that the can may be easily flattened and conveniently stored. Prior devices have been devised to operate upon the entire can in a brute force manner in order to crush it. Such devices are usually large, bulky and require considerable force to use because a cylindrical can with both end caps in place has considerable structural strength. The result of these prior crushing methods has only been a space savings of about one-quarter when the crushed can are closely nested.

OBJECTS OF THE INVENTION

It is an object of the present invention to provide an apparatus for flattening aluminum cans.

A yet further object is to provice a device to individually flatten cylindrical aluminum cans manually.

BRIEF DESCRIPTION OF THE DRAWINGS

Further objects and advantages of the present invention may be readily ascertained by referring to the following description and appended illustrations, in which.

DETAILED DESCRIPTION OF THE PREFERRED EMBODIMENT

Figure 1:
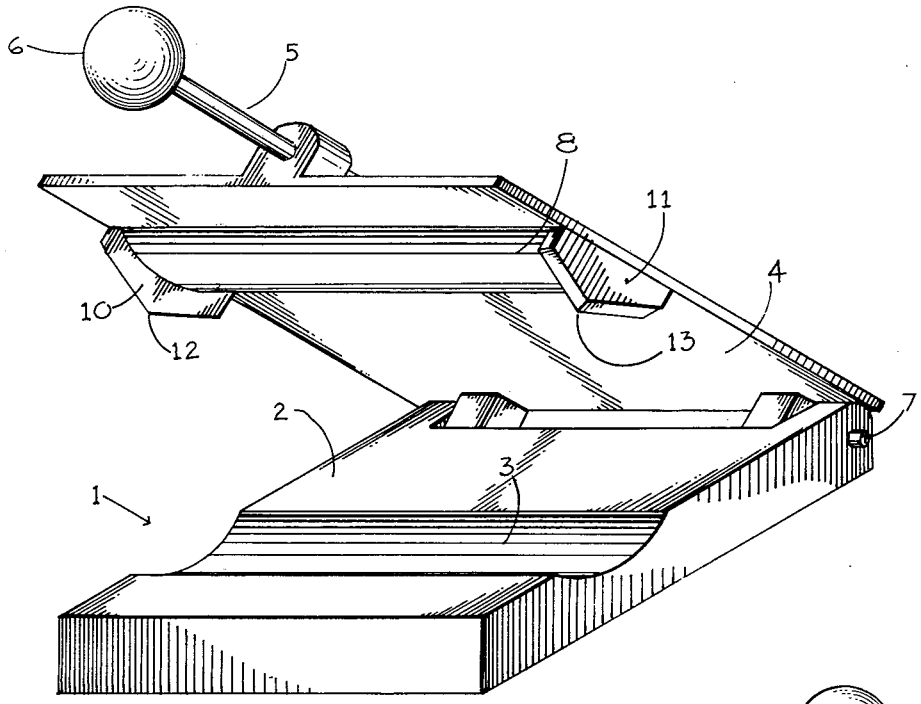
FIG. 1 is a prespective view of the apparatus according to the invention.
Figure 2:
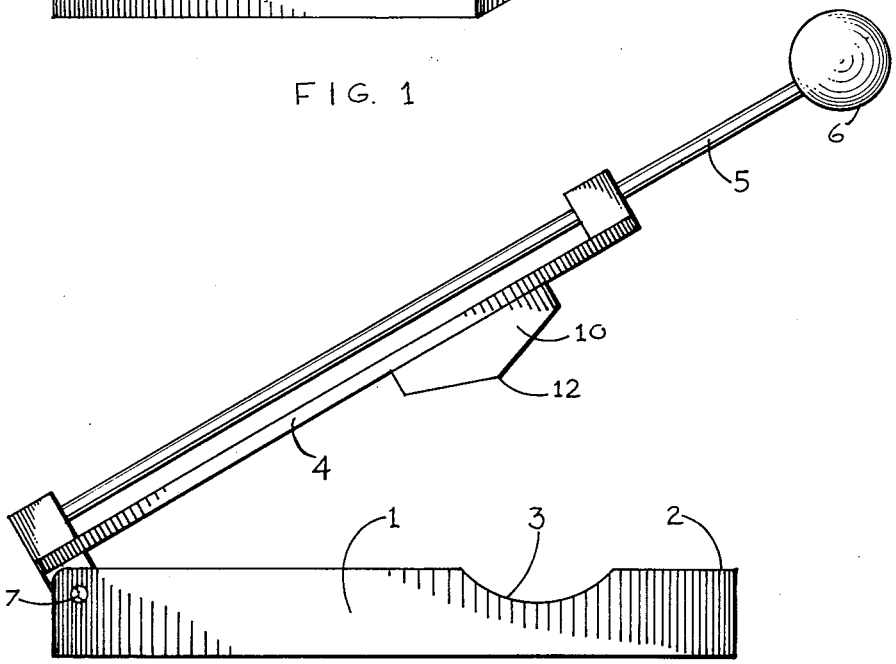
FIG. 2 is a side view of the apparatus of FIG. 1.

The apparatus shown in the drawings includes a base, indicated in general by numeral 1, having a planar upper surface 2 with an elongated concave depression 3 formed therein for supporting a cylindrical metal can of selected size lying on its side. The depression should be deep enough that a typical cylindrical can lies stably therein with the longitudinal axis of depression 3 parallel to the cylindrical axis of the can. Preferably, the length of the elongated depression 3 is less than the can length. In general, base 1 may be fabricated from any non-deforming material capable of supporting compressive loads. Since the base 1 is to be utilized on kitchen countertops, it may be provided with rubber supporting pads or feet as are conventionally found upon appliances.

A rigid moment arm 5, including an end knob 6, is fixed to a flat plate 4 which is pivotally attached to the base by a hinge shaft 7 which extends horizontally across the back of the base. The hinge itself may be of any conventional type. Fixed to the plate 4 is a die member 8 having an arcuate or convex face which is elongated in the direction of the longitudinal axis of depression 3. The die is slightly shorter than a typical can, but is longer than the can-locating depression. The radius of curvature of the die surface should be substantially the same as the radius of the can-locating depression and the die member should be arranged on the plate 8 so that when the plate pivots downward to the base, the die member 8 lies in the depression 3. In other words, the die member is at the same distance from the hinge as is the depression.

Cutting members 10 and 11, respectively, are fixed at each end of die member 8 transverse to the longitudinal axis thereof. The members are essentially cutting blades; accordingly, their thickness should be small compared to their length and width. The cutting edges may be sharpened or serrated as desired. The cutting members 10 and 11 taper towards points 12 and 13, respectively, about medially of the width of the die. The points 12 and 13 are arranged to initially pierce the body of a cay lying in depression 3 before the blades begin to shear through the can walls. Furthermore, points 12 and 13 aid in finally severing the can ends from the body since they will usually pierce the last remaining bit of metal holding the end to the body.

In operation a cylindrical aluminum can is horizontally laid in depression 3 and the arm 5 carrying die member 8 is pivoted downwardly by grasping the knob 6 or arm 5. Cutting members 10 and 11 then initially pierce the can body and die member 8 subsequently "flatten" the can in the depression. In practice, a "flattened" can usually have a slightly arcuate configuration which conforms to the shape of the die member. In the final condition, the can ends usually are sheared completely from the can body by the cutting blades. If the can ends are not completely sheared, they may be easily bent back by hand over the then flattened can body with little loss of compactness. Touching the sheared or torn edges of an aluminum can is quite safe; there is little danger of cutting oneself as with iron cans. When the base is longer than the typical can length, slots can be formed in the base to accept the cutting members when the die member reaches the base.

We claim:

1. Apparatus for individually flattening selected size cylindrical metal cans comprising:

a. a horizontally disposed base having an elongated concave depression formed in the planar upper surface thereof for supporting a cylindrical can lying in said depression;

b. a moment arm;

c. hinge means hinging said arm to said base for pivotal movement of said arm downward toward said base transverse to said depression;

d. an arcuate die member fixed to said arm presenting a convex face towards said base, the radius of curvature of said convex face being substantially the same as the radius of said concave depression, said die member being arranged on said moment arm to press against the body of a can lying in said depression when said moment arm is pivoted downwardly toward said base;

e. two cutting members each which tapers to a point, one said cutting member fixed along each end of said die member protruding beyond its said face, for shearing into a can slightly back from the ends thereof in advance of said die member when said moment arm pivots said die member downwardly to press flat the body of a can lying in said depression in said base.

2. Apparatus according to claim 1 wherein said cutting members taper towards a point about medial of the width of said die member for initially piercing the body of a can.

3. Apparatus according to claim 1 including a handle integral with said moment arm.

4. Apparatus according to claim 1 wherein said hinge means includes a horizontally disposed hinge shaft which is parallel to the longitudinal axis of said depression and said die member is fixed to said plate at about the same distance from said hinge shaft as is the depression.

* * * * *